United States Patent [19]

Hickling

[11] Patent Number: 4,682,141

[45] Date of Patent: Jul. 21, 1987

[54] DYNAMICALLY OPTIMIZED THERMOSTAT (DOT) WITH TUNABLE BIMETAL ELEMENT

[75] Inventor: Colin D. Hickling, Frankfort, Ky.

[73] Assignee: Trig, Inc., Frankfort, Ky.

[21] Appl. No.: 830,227

[22] Filed: Feb. 18, 1986

[51] Int. Cl.[4] ..... H01H 37/52

[52] U.S. Cl. ..... 337/379; 337/111; 337/368

[58] Field of Search ..... 337/379, 349, 368, 111

[56] References Cited

U.S. PATENT DOCUMENTS

| | | | |
|---|---|---|---|
| 2,415,473 | 2/1947 | Dougherty . | |
| 2,647,189 | 7/1953 | De Puy . | |
| 2,716,175 | 8/1955 | Franklin | 337/349 |
| 3,124,957 | 3/1964 | Bungo . | |
| 3,550,055 | 12/1970 | Grover | 337/100 |
| 3,593,253 | 7/1971 | Taylor | 337/379 |

FOREIGN PATENT DOCUMENTS

| | | | |
|---|---|---|---|
| 2448026 | 4/1976 | Fed. Rep. of Germany | 337/111 |
| 106125 | 12/1942 | Sweden | 337/379 |

*Primary Examiner*—Harold Broome

*Attorney, Agent, or Firm*—King and Schickli

[57] ABSTRACT

A tuning element for a temperature responsive switch includes a bimetal assembly in the form of an elongated, relatively flat bimetal strip with bending action and including integral tuning webs for adjusting the thermodynamic properties of the element. Multiple apertures are punched in a predetermined pattern in the bimetal strip to form the webs. Each of the webs is also bent in alternate directions to form ribs that reinforce the element. The bimetal strip is formed from a bimetal base portion and extension portion butt welded together; the webs being formed in the strip adjacent the weld joint. The base portion of the strip bends to open the contacts and the extension portion bends to bring the contacts back closer together, thereby controlling overshoot and providing consistent operation within a relatively narrow temperature range. A method of tuning the thermodynamic properties of a bimetal strip includes the steps of forming a plurality of spaced tuning webs in the strip and bending the webs to form reinforcing ribs. The size and number of the apertures is selected to optimize the control of the heat flow to the bimetal extension portion.

18 Claims, 7 Drawing Figures

DYNAMICALLY OPTIMIZED THERMOSTAT (DOT) WITH TUNABLE BIMETAL ELEMENT

TECHNICAL FIELD

The present invention relates to thermostatic switches and, more particularly, to a thermodynamically tuned actuator element for a thermostatic switch and method of producing the same. The element provides compensation and control of initial overshoot and consistent operation of the heating element within a relatively narrow temperature range during normal operation. A dynamically optimized thermostat incorporating the tuned actuator element with contacts mounted on cooperating spring members is also provided.

BACKGROUND ART

Thermostatic switches for high temperature operation are well known in the art. These switches are used in various applications, one of the most notable of which is for appliances, such as electric irons. In an electric iron, the thermostatic switch is responsive to the heat of the soleplate, upon which it is mounted. The switch cycles on and off to maintain the temperature of the soleplate of the iron within the desired set range.

The typical prior art switch structure includes spring members to support the respective electrical contacts. A bimetal element is provided for engaging one of the spring elements as the temperature of the switch rises to break the contacts and interrupt the current to the electric heating element.

In the past, the attempts to design a new type of thermostatic switch have been generally focused on achieving better operating characteristics for a particular type of heat source. One of the most recent improvements in this category is my prior U.S. Pat. No. 4,495,481, issued on Jan. 22, 1985, and assigned to the same assignee as the present invention. In my prior thermodynamic switch, I am successful in alleviating the problems of (1) temperature overshoot that tends to occur on the initial operating cycles of the device, and (2) improving the consistency of operation and thus maintaining a more constant temperature. The switch manufactured in accordance with my '481 invention and patent is proving to be very successful in the particular environment for which it was designed.

More specifically, my previous switch was designed for a particular iron having specific heating characteristics. The line of irons upon which the switch of the '481 invention is utilized exhibits greatly enhanced operational characteristics. As a consequence, the line of irons using my switch are commercially very successful.

Even with the success of the previous switch design, it has been found not to be easily adaptable to other types of irons or other heating appliances, and thus these appliances leave something to be desired in terms of performance. While the switch of my previous design works better than those of the past, the cycling characteristics in other environments than the iron for which it was designed are simply not as favorable as they could be.

It is also a universal problem in the prior art that designing a switch for a particular iron or other appliance generally ups the cost of the switch. Not only is it necessary to order a wide variety of component parts, such as bimetal elements, but also the manufacturing procedures, including the fabricating operations and assembly, must be changed for each switch. If the parts for several switches to fit several different lines of appliances could be standardized and the manufacturing procedures simplified, the cost of switches can be reduced.

Thus, a dual need has been identified for thermostatic switches of the type used in irons or other heating appliances. A switch that can be finely tuned to fit the heating characteristics of different appliances, such as a wide variety of irons, is needed, and especially the need is great for applying this concept while maintaining control of the initial overshoot. In particular, a switch that can be tuned to virtually eliminate temperature overshoot of the appliance and closely regulate and control the operation during use is highly desirable. At the same time, the cost of manufacturing is reduced since the parts and the manufacturing procedures can be better standardized.

SUMMARY OF THE INVENTION

Accordingly, it is a primary object of the present invention to provide an inexpensive and improved tuned actuator element for a temperature responsive switch that provides control of initial overshoot and consistent operation of a heating element within a relatively narrow temperature range.

Another object of the present invention is to provide an actuator element with integral tuning for improved reliability, efficiency, versatility and performance.

Still another object of the present invention is to provide a temperature responsive switch substantially eliminating initial overshoot and furnishing more consistent operation of a heating element over a relatively narrower and more accurate temperature range.

A further object of the present invention is to provide a temperature responsive switch of simple construction that may be tuned to individual characteristics of heating elements of various designs.

A still further object of the present invention is to provide a novel and improved method of tuning an actuator element for a temperature responsive switch that dynamically improves heating element performance.

Another object of the present invention is to provide a method of tuning an actuator element for a temperature responsive switch utilizing computer analysis and analytical procedures to match the actuator element to the heating element to be controlled.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved tuned actuator element for a temperature responsive switch does provide control of initial overshoot and consistent operation of a heating element within a relatively narrow temperature range. The tuned actuator element comprises a bimetal assembly in the form of an elongated, relatively flat bimetal strip. The bimetal strip provides multidirectional bending action to open and close the electrical contacts of the temperature responsive switch. This action is designed to substantially eliminate overshoot and provide operation over a narrow temperature range. A plurality of spaced, relatively narrow connecting webs separated by at least one aperture across the bimetal strip provides the bimetal strip with integral tuning. By selecting the proper web/aperture combination, the designer can modify the thermodynamic properties of the element, as desired for a particular use.

Preferably, there are more than two relatively narrow connecting webs between multiple apertures. The webs are bent so as to form a rib or ribs. As should be appreciated, these ribs reinforce the tuned actuator element. The thus modified and reinforced element resists bending and breaking, as might otherwise occur, for example, when the iron to which the tuned actuator element is attached is inadvertantly dropped. In order to provide maximum strength without adversely affecting the operation of the bimetal element, adjacent connecting webs include ribs extending in opposite directions from the plane of the bimetal strip.

The bimetal strip further includes a bimetal base portion and a bimetal extension portion. The bimetal base and extension portions are electron beam butt welded together at a joint. The bending action of the base portion in response to heat as, for example, from the sole of an iron, serves to move the contacts apart and provide the upper limit of the operating temperature range of the iron. Conversely, the bending action of the extension portion is in the opposite direction serving to bring the contacts closer together. To reduce overshoot when designing an actuator element, the designer generally reduces the size of and relocates the webs to provide just the right amount of heat flow choking or throttling effect. Thus, on the first few cycles, there is less bending of the extension portion. This design work also takes into account the heat equilibrium stage after the iron is fully heated so that the on/off cycling is properly controlled by the opposite bending action of the extension. Thus, the extension portion substantially prevents overshoot on the initial heating cycles and at the same time aids in providing consistent cycle frequency and consistent temperature on subsequent cycles of the contacts.

Preferably, the multiple apertures and connecting webs are positioned adjacent the weld joint. This allows the selection of a predictable rate of heat transfer across the joint. The predictability is what provides the very favorable operating characteristics. It is important also to note that this can be accomplished for any desired switch operating range even though the beam weld area before the webs are formed can cause a variation in the heat transfer rate. In effect, the multiple apertures and connecting webs allow the designer to apply a known thermal delay in this area that allows the tuning of the actuator element as desired for the particular use contemplated.

In accordance with a further aspect of the present invention, a temperature responsive switch or thermostat is provided utilizing the inventive tuned actuator element so as to provide control of initial overshoot and consistent operation of the heating element within a narrow temperature range. The switch comprises a first contact mounted on a first spring member and a second cooperating contact mounted on a second spring member. A tuned actuator element as described above is adapted to engage one of the spring members to break the contacts in the manner desired to give the superior operating characteristics.

Advantageously, the completed temperature responsive switch is fine tuned through the actuator element to meet almost any desired operational characteristics of different heating elements. Since a single switch structure constructed in accordance with the teachings of the present invention may be tuned to effectively and properly control heating elements of various designs, manufacturing costs, including cost of parts, manufacturing expenses and inventory are greatly reduced. For each different switch, the only change necessary is to punch the desired number and size of apertures in the proper location to give the desired throttling or thermal delay effect to heat transfer between the bimetal base and extension portions.

In accordance with yet another aspect of the present invention, a method of tuning the thermodynamic properties of the bimetal strip is provided. The initial step of the method involves forming a plurality of space connecting webs in the bimetal strip by making at least one aperture in the strip. The relatively thin connecting webs provide a known thermal delay to the passage of heat along the bimetal strip allowing the tuning of the thermodynamic properties of the strip. An additional step of the method involves bending the connecting webs so as to provide ribs in the webs. As discussed above, these ribs reinforce the strip so as to resist bending and/or breaking in the event of sudden jarring motions.

Preferably, the method includes the additional step of choosing the size and number of the apertures between the connecting webs in accordance with analytical methods. Such choices enable the incremental heat flow along the bimetal strip to be precisely controlled at each position in the bimetal strip so as to provide accurate thermodynamic wave shaped manipulation and thus optimization of the thermodynamic response of the thermostat incorporating the strip. By this method it should be appreciated that a temperature responsive switch may be tuned to provide optimum performance of a wide range of heating element designs.

The method may also include the additional step of positioning the apertures on the bimetal strip to provide connecting webs at predetermined locations along and across the strip to thereby produce a bimetal strip that best controls overshoot and provides the most consistent operating temperature range properties.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects, all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Figure 1:
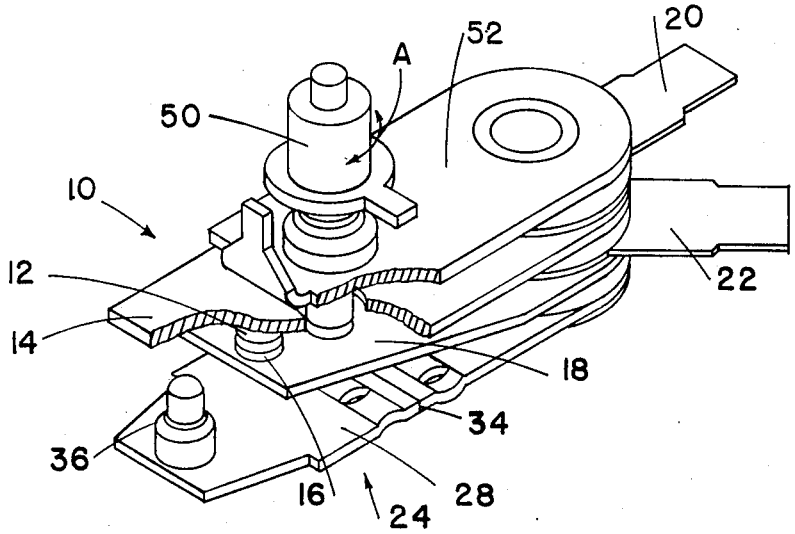
FIG. 1 is a perspective view of a temperature responsive switch of the present invention.
Figure 2:
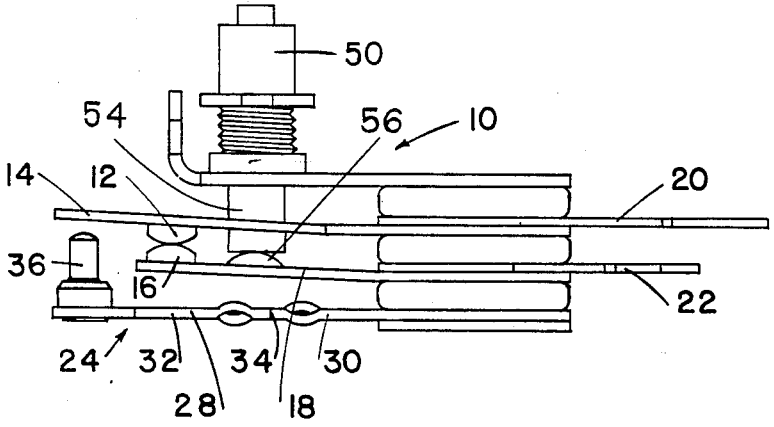
FIG. 2 is a side elevational view of the temperature responsive switch of FIG. 1 before initiation of a heating cycle.

Reference will now be made in detail to the present preferred embodiment of the invention, an example of which is illustrated in the accompanying drawing.

DETAILED DESCRIPTION OF THE INVENTION

Reference is now made to FIGS. 1–4 showing the thermostatic or temperature-responsive switch 10 of the present invention. The switch 10 is designed for operation in a temperature range well above the normal ambient temperature, such as found in an iron or other similar high temperature appliance. As will be appreciated below as a result of the design of the switch 10, the temperature control during all operating cycles, including the initial cycles, are consistent within a narrow temperature range.

The switch 10 includes a first contact 12 mounted on a first spring member 14 and a second contact 16 mounted on a second spring member 18. As is known in the art, contacts 12, 16 are designed to make and break an electrical circuit for controlling the electric current through an iron or similar appliance. Terminals 20, 22 provide connection to the spring members 14, 18 and contacts 12, 16, respectively. Spadetype connectors (not shown) are connected in the circuit for the heating element of the iron. As will readily be understood, as the contacts 12, 16 make and break contact, the heating element is cycled on and off to control the temperature.

Figure 3:
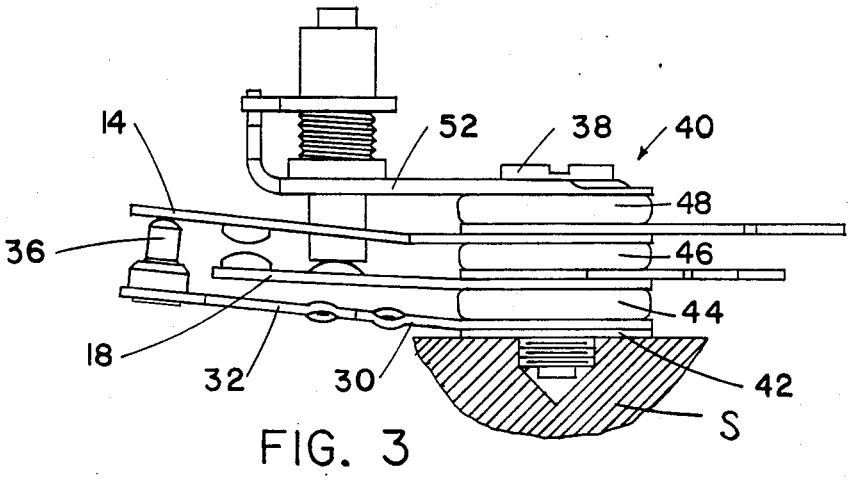
FIG. 3 is a side elevational view of the switch of FIG. 2 showing the end of the initial heating cycle of the switch with the contacts open.
Figure 4:
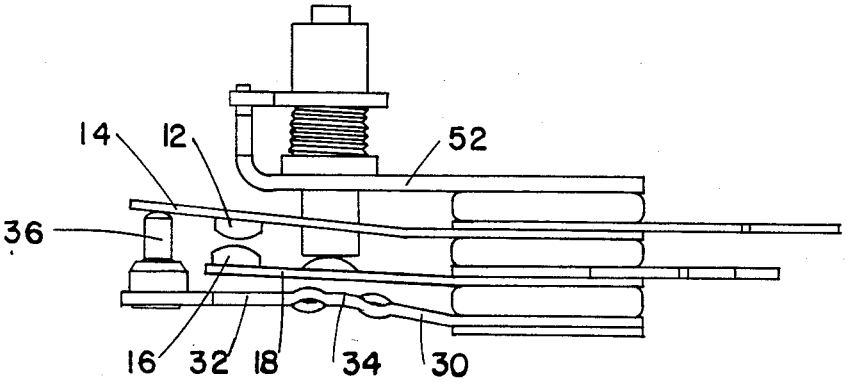
FIG. 4 is a side elevational view of the switch of FIG. 2 showing the end of a heating cycle and the opening of the contacts subsequent to the initial heating cycle.
Figure 5:
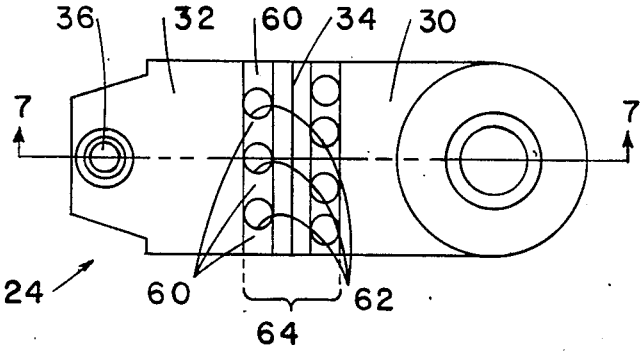
FIG. 5 is a top plan view of the tuned actuator element of the present invention.
Figure 6:
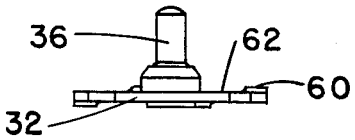
FIG. 6 is an end elevational view of the same actuator element shown in FIG. 5.
Figure 7:
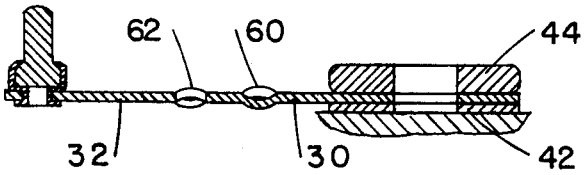
FIG. 7 is a cross-sectional view of the actuator element taken along lines 7—7 of FIG. 5

In order to make and break the contacts 12, 16 as indicated, the switch 10 is provided with a tuned actuator element generally designated by reference numeral 24. The actuator element 24 comprises a bimetal assembly in the form of an elongated bimetal strip 28. As best shown in FIGS. 5–7, the bimetal strip 28 includes a base portion 30 and a bimetal extension or compensating portion 32. The base and extension portions 30, 32 are electron beam butt welded together at the joint 34. As shown in FIGS. 3 and 4, the element 24 also includes an insulator button 36 on the extension portion 32 that engages the spring member 14 to lift the contact 12 from engagement with the contact 16.

The bimetal assembly is mounted on the soleplate S of the iron, or other similar heated surface to be controlled. Thus, the soleplate S (see FIG. 3) provides for rapid heat transfer in order to provide maximum response of the switch 10 to temperature change. A threaded mounting stud 38 passes through an insulator stack generally designated by reference numeral 40. As is known in the art, insulator stack 40 functions to electrically separate the spring elements 14, 18 and the actuator element 24. Stack 40 includes a rivet 42 and a plurality of ceramic insulator discs 44, 46 and 48 (all shown in FIG. 3).

In order to provide adjustment for the desired temperature setting of the iron, a threaded adjustment shaft 50 is mounted to a support arm 52 positioned on top of the insulator stack 40. As the shaft 50 is turned (note action arrows A in FIG. 1) an adjustment rod 54 fabricated of insulated material, such as ceramic, is operative to reposition the spring member 18. The ceramic rod 54 actually engages a dimple 56 on the spring member 18 in order to insure low friction turning of the shaft 50 and accurate movement of the spring member. The spring member 18 is tensioned to constantly engage the operative end of the insulator rod 54 and thus follow the adjusted position. Similarly, the tension in the spring member 14 is such as to provide constant engagement between the contacts 12, 16. Thus, even in the stand-by position electric current will flow through the switch 10.

As will be apparent and discussed in more detail below, at any time during operation when the temperature sensed by the bimetal assembly 24 reaches the appropriate temperature level, the insulator button 36 engages the distal portion of the spring member 14 and raises the contact 12 from engagement with the contact 16 against the spring force in the spring member 14 (see FIGS. 3 and 4). Conversely, as the iron cools, the button 36 once again moves away and the contacts reengage. This results in the repeated making/breaking of the circuit and the successful cycling of the heating element being controlled.

The more detailed action of opening the contacts 12, 16 can best be seen by carefully reviewing FIGS. 3 and 4. Here, the initial heat received by the actuator element 24 causes upward bending and thus engagement of the insulator button 36 with the spring member 14 and opening of the contacts 12, 16. With the contacts 12, 16 then open and the heating element of the soleplate S turned off, the actuator element 24 cools, causing a relaxation and return movement to the stand-by or cool position shown in FIG. 2. Of course, during normal cycling of the heating element, the actuator element 24 moves downwardly from the positions shown in FIGS. 3 and 4 only so far as required to once again engage the contacts 12, 16.

When a change in temperature is desired, the shaft 50 is simply rotated to move the spring members 14, 18 and contacts 12, 16 together in an up-or-down direction. With the repositioning, this simply means that the actuator element 24 has to move to a higher position (higher temperature) or a lower position (lower temperature) to provide the desired opening and closing of the contacts 12, 16.

As described above, the switch 10 incorporates an actuator element 24 that is tuned to the iron or other appliance to which it is applied in order to substantially eliminate the problem of initial overshoot and provide consistent operation within a narrow temperature range. With a mismatched switch, as has been common in the past, when the iron is first turned on, the tendency is for the contacts of the switch to open later than required to establish the proper temperature. This is caused (as on the initial cycle) by the ambient temperature of the iron being relatively cool and the actuator element 24 losing some heat by convection. The result is a significant increase in initial temperature that provides deleterious effects, such as the damaging of fabric being ironed from too high a temperature.

Furthermore, irons with mismatched thermostatic switches of the prior art suffer from cycling problems; i.e. resulting from the installation in an iron of a switch including an actuator element not specifically tuned to the particular make and model of iron. In certain instances, the switch cycles the contacts rapidly making and breaking the circuit in an attempt to closely control the temperature. While such cycling maintains a narrow temperature range of operation, it should be recognized that too rapid cycling is unattractive. It leads to a great deal of radio noise each time the contacts are closed. Further, rapid cycling can damage the contacts over time. In extreme cases, rapid cycling may even cause the contacts to melt, thus destroying switch operation and resulting in the need to repair the iron. Conversely, a switch with a mismatched or untuned actuator element could also cause the contacts to cycle too slowly at a large amplitude. Disadvantageously, this means that at one temperature setting the iron could burn the fabric one moment and at the next moment be too cool to iron properly.

In order to overcome these and other problems as set forth above, the actuator element 24 of the present invention includes integral tuning in the form of a relatively flat, composite bimetal strip 28, 30 with connecting webs and at least one aperture. Preferably, there is provided a plurality of spaced, relatively narrow connecting webs 60 between multiple apertures 62, as best shown in FIG. 5. There are two rows of aligned connecting webs 60 and apertures 62 provided extending transversely across the bimetal strip 28. One row of webs 60 and apertures 62 are provided adjacent each side of the butt weld joint 34 between the bimetal base and extension portions 30, 32. Since the apertures 62 reduce the cross-sectional area of the connecting webs 60 to a selected fraction of the full bimetal strip 28 area, there is a desired proportional reduction in heat transfer between the two bimetal portions 30, 32. This throttling effect is what provides the elimination of overshoot and consistent normal cycling, as described above and further set forth in detail below.

Because of the removal of metal by forming the apertures 62, the webs 60 are ribbed to increase their strength, in accordance with a more specific feature of the invention. As best shown in FIGS. 6 and 7, the webs 60 are alternately bent above and below the plane of the bimetal strip 28 to form the ribs substantially perpendicular to the longitudinal axis L of the strip. Thus, adjacent connecting webs 60 in a row include ribs extending in opposite directions from the plane of the strip 28. Such a bending pattern not only increases the reinforcement of the bimetal strip 28 in the area of the connecting webs 60 but also does not deleteriously affect the heat transfer properties of the actuator element.

When the iron is first turned on (note FIG. 2), the soleplate S heats up due to the engagement of the contacts 12, 16. Heat from the soleplate S is directly transferred in the desirable manner to the actuator element 24. The base bimetal portion 30 nearest to the stack 40 bends upward and responds rapidly to the change in temperature of the soleplate S. The extension bimetal portion 32 responds more slowly because the direct heat that it obtains is throttled by the limited cross sectional area of the webs 62. As the base bimetal portion 30 is thus heated, the button insulator 36 is lifted so as to finally engage the spring element 14 and separate the contacts 12, 16 as previously described. The set temperature of the switch is thus established by the operation on this initial cycle. The heat from the soleplate S is directly transferred by conduction through the stack 40 to the base bimetal portion 30 and the heat is transfered sufficiently to cause the bimetal portion 30 to bend and open the contacts 12, 16.

It should be recognized, however, that on the initial cycle, the ambient temperature of the iron is still relatively cool. This means that the base bimetal portion 30 during the initial cycle will lose a significant amount of heat by convection. Thus, after the initial warmup, it will be clear that the upward bending action of the base bimetal portion 30 is greater than occurred on the initial cycle, as shown in FIG. 4. It is for this reason that the extension bimetal portion 32 is mounted in accordance with the present invention to provide downward bending motion (that is, in the opposite direction). Thus, on subsequent cycles after heat is able to penetrate the reduced webs 62 and more heat is present by convection to affect the bimetal extrusion portion 32, there is a compensating action and the composite element 24 continues to open the contacts at substantially the same temperature established on the initial cycle.

To explain further, the present invention advantageously provides the known thermal delay across the weld joint 34 through the utilization of the spaced, relatively narrow connecting webs 60 between apertures 62. In effect, the narrow connecting webs 60 reduce the flow of heat through tuning region 64 into the bimetal extension portion 32 to a known level. As such, any actuator element 24 with a joint 34 having a cross section (above approximately 30% of the original bimetal strip cross section) provides a known heat flow to the bimetal extension portion 32 and predictable and consistent compensation for initial overshoot.

As an additional advantage, the webs 60 are positioned so as to assure that substantially the entire base bimetal portion 30 is heated to an even temperature. This uniform heating results in the elimination of any tendency of the base portion 30 to dish and lose its flexibility. Consequently, complete bending action of the base bimetal portion 30 is assured on the initial and all subsequent cycles.

In effect, the thermodynamics of the actuator element 24 may be tuned in accordance with analytical methods to match the thermodynamics of the make and model of iron or other appliance to which it is to be applied. As such, not only can overshoot be controlled and substantially eliminated as described above, but the operation amplitude of a switch incorporating the actuator element can be controlled. Consequently, contact damage from too rapid cycling is prevented while operation of the appliance within a narrow temperature range is advantageously assured.

The tuned actuator element 24 of the present invention is relatively easy and inexpensive to produce. The thermodynamic properties of the standard relatively flat element 24 may be easily tuned to a particular application as, for example, for use in a particular make and model of iron. This is done by simply forming a plurality of spaced connecting webs 60 in the tuning region 64 of the bimetal strip 28 as, for example, by drilling or punching apertures 62 in the strip. There is no need to provide tapered sections, bend the edge of the element or dish out either portion to gain the desired results.

As best shown in FIG. 5, the connecting webs 60 and apertures 62 are aligned adjacent each side of the butt weld joint 34 that connects the bimetal base and extension portions 30, 32. The steps of determining or choosing the size, number and position of the apertures 62 and, therefore, the connecting webs 60 are performed in accordance with computer analysis of the actuator element 24 and the particular appliance to which the element is to be applied. By this manipulation of the webs 60 and apertures 62, the throttled heat flow along the bimetal strip 28 may be precisely controlled so as to provide the optimal thermodynamic response of the thermostat/appliance system.

Of course, the forming of the apertures 62 in the bimetal strip 28 requires the removal of material from the strip that weakens the strip in the tuning region 64. This loss of strength is recovered and the strip 28 reinforced by bending the connecting webs 60 so as to provide ribs in the individual webs.

In summary, numerous benefits have been described which result from employing the concepts of the present invention. By choosing the size, number and position of the connecting webs 60 and apertures 62 during production, a manufacturer may tune the actuator element 24 to meet particular application needs. No longer is the manufacturer required to produce a large number and wide variety of temperature responsive switches with actuator elements having different configurations. Now the manufacturer can simply maintain an actuator element 24 comprising a simple, relatively flat bimetal strip 30, 32 including a tuning region 64. Apertures are punched or drilled in this region in order to tune the element to meet its ultimate use.

Advantageously, a temperature responsive switch 10 provided with a tuned actuator element 24 constructed in accordance with the teachings of the present invention, controls and substantially eliminates the problem of initial overshoot by throttling the initial heat transfer, while also providing accurate, consistent and reliable operation over the desired temperature range during normal cycling.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A tuned actuator element for a temperature responsive switch that provides control of initial overshoot and consistent operation of a heating element within a relatively narrow temperature range by opening and closing electrical contacts, comprising:

a bimetal assembly in the form of an elongated, relatively flat bimetal strip with bending action to open and close the contacts, said strip including a bimetal base portion and a bimetal extension portion connected together at a joint and integral tuning means for modifying the thermodynamic properties of the element; said tuning means including a plurality of spaced, relatively narrow connecting webs separated by at least one aperture in said bimetal strip for controlling the flow of heat through said strip and across the joint between the base and extension portions.

2. The tuned actuator element of claim 1, wherein each of said connecting webs is bent to form a rib that reinforces said element.

3. The tuned actuator element of claim 2, wherein adjacent connecting webs include ribs extending in opposite directions from a plane containing said bimetal strip.

4. The tuned actuator element of claim 2, wherein each of said ribs is formed on said connecting webs substantially perpendicular to the longitudinal axis of said bimetal strip.

5. The tuned actuator element of claim 1, wherein said connecting webs are substantially aligned across said bimetal strip.

6. The tuned actuator element of claim 1, wherein said bimetal base and extension portions are electron beam butt welded together at said joint, the bending action of said base portion in response to heat serving to move the contacts apart for opening, the bending action of said extension portion serving to bring the contacts closer together, whereby overshoot on the initial heating cycle is prevented and consistent cycle frequency on subsequent cycles is attained.

7. The tuned actuator element of claim 1, wherein is provided multiple apertures to form said webs across said element.

8. The tuned actuator element of claim 7, wherein said multiple apertures and webs are positioned adjacent said joint.

9. The tuned actuator element of claim 8, wherein two aligned rows of multiple apertures and connecting webs are provided across said bimetal strip, one row on each side of said joint.

10. The tuned actuator element of claim 1, wherein a distal end of said bimetal strip is tapered and an insulation button is mounted thereon.

11. The tuned actuator element of claim 1, wherein said strip including said webs lies generally in a single plane.

12. A temperature responsive switch that provides control of initial overshoot and consistent operation of a heating element within a narrow temperature range, comprising:

a first contact mounted on a first spring member;

a second contact mounted on a second spring member for cooperation with said first contact; and a tuned actuator element including a bimetal assembly in the form of an elongated, relatively flat bimetal strip having a base portion and extension portion connected together at a joint, said bimetal strip providing bending action to open and close the contacts, said strip including integral tuning means for modifying the thermodynamic properties of the element; said tuning means including a plurality of spaced, relatively narrow connecting webs separated by at least one aperture in said bimetal strip for controlling the flow of heat through said strip and across the joint between the base and extension portions, said tuned actuator element being adapted to engage one of said spring members to break said contacts, and thereby substantially eliminate initial overshoot and provide consistent operation of said heating element within a narrow temperature range.

13. The temperature responsive switch of claim 12, wherein said bimetal base and extension portions are butt welded together at said joint, the bending action of said base portion in response to heat serving to move the contacts apart for opening, the bending action of said extension portion serving to bring the contacts closer together, whereby overshoot on the initial heating cycle is prevented and consistent cycle frequency on subsequent cycles is attained.

14. A method of tuning the thermodynamic properties of a relatively flat bimetal strip having a base portion and extension portion connected together at a joint for controlling initial overshoot and providing consistent operation of a heating element within a relatively narrow temperature range, comprising the steps of:

forming a plurality of spaced, relatively narrow connecting webs in the bimetal strip by making at least one aperture in the strip; and positioning said at least one aperture in said bimetal strip to provide connecting webs at predetermined locations along and across said bimetal strip for controlling the flow of heat through said strip and across the joint between the base and extension portions and to thereby produce a bimetal strip to control overshoot and provide consistent operating temperature range properties.

15. The method of claim 14 including the additional step of bending said connecting webs so as to provide ribs in said webs that reinforce said strip.

16. The method of claim 14 including the additional step of forming multiple apertures to form said webs.

17. The method of claim 16 including the additional step of aligning the spaced connecting webs and apertures on the strip adjacent each side of said joint connecting said base bimetal portion with said extension bimetal portion of said bimetal strip.

18. The method of claim 14 including the additional step of choosing the size and number of the apertures between the webs in accordance with analytical methods so as to provide thermodynamic wave-shape manipulation and optimize the thermodynamic response of said bimetal strip.

* * * * *